US012410603B2

(12) United States Patent
Richards

(10) Patent No.: US 12,410,603 B2
(45) Date of Patent: Sep. 9, 2025

(54) COLUMN-TO-BEAM CONNECTION SYSTEMS INCLUDING A SHEAR COMPONENT

(71) Applicant: DURAFUSE FRAMES, LLC, West Jordan, UT (US)

(72) Inventor: Paul William Richards, Orem, UT (US)

(73) Assignee: DURAFUSE FRAMES, LLC, West Jordan, UT (US)

( * ) Notice: Subject to any disclaimer, the term of this patent is extended or adjusted under 35 U.S.C. 154(b) by 675 days.

(21) Appl. No.: 17/633,677

(22) PCT Filed: Aug. 5, 2020

(86) PCT No.: PCT/US2020/044982

§ 371 (c)(1),
(2) Date: Feb. 8, 2022

(87) PCT Pub. No.: WO2021/030111

PCT Pub. Date: Feb. 18, 2021

(65) Prior Publication Data

US 2022/0316202 A1 Oct. 6, 2022

Related U.S. Application Data

(60) Provisional application No. 62/884,901, filed on Aug. 9, 2019.

(51) Int. Cl.
*E04B 1/24* (2006.01)
*E04H 9/02* (2006.01)

(52) U.S. Cl.
CPC ..... *E04B 1/2403* (2013.01); *E04H 9/024* (2013.01); *E04B 2001/2445* (2013.01);
(Continued)

(58) Field of Classification Search
CPC ..... E04B 1/2403; E04B 2001/2445; E04B 2001/2448; E04B 2001/2457; E04B 2001/2496; E04H 9/024
See application file for complete search history.

(56) References Cited

U.S. PATENT DOCUMENTS 1,727,293 A 9/1929 Andrew
4,014,089 A 3/1977 Sato et al.
(Continued)

FOREIGN PATENT DOCUMENTS

CL 201400272 12/2014
CL 201503172 9/2016
(Continued)

OTHER PUBLICATIONS

Amendment filed by Applicant in counterpart Canadian Application No. 3,146,932 (8 pages). (Year: 2025).*
(Continued)

*Primary Examiner* — Rodney Mintz
(74) *Attorney, Agent, or Firm* — Ballard Spahr LLP

(57) ABSTRACT

Column-to-beam connection systems are disclosed herein, along with moment-resisting frames including the same and methods of repairing the same. An example column-to-beam connection system includes a shear component. The shear component includes a base plate that is connected to a column flange. The shear component also includes at least one vertical web extending from the base plate. The vertical web is connected to with a beam flange. The vertical web also defines one or more openings therein.

19 Claims, 9 Drawing Sheets

(52) U.S. Cl.
CPC ..... *E04B 2001/2448* (2013.01); *E04B 2001/2457* (2013.01); *E04B 2001/2496* (2013.01)

(56) References Cited

U.S. PATENT DOCUMENTS

| | | | | |
|---|---|---|---|---|
| 4,926,592 | A | 5/1990 | Nehls | |
| 5,148,642 | A | 9/1992 | Plumier et al. | |
| 5,660,017 | A | 8/1997 | Houghton | |
| 6,073,405 | A | 6/2000 | Kasai et al. | |
| 6,138,427 | A | 10/2000 | Houghton | |
| 6,264,162 | B1 | 7/2001 | Barnes et al. | |
| 6,739,099 | B2 | 5/2004 | Takeuchi et al. | |
| 7,040,069 | B2 | 5/2006 | Simmons | |
| 7,530,205 | B2 | 5/2009 | Simmons | |
| 8,683,758 | B2 | 4/2014 | Christopoulos et al. | |
| 8,800,239 | B2 | 8/2014 | Yang | |
| 8,875,452 | B2 | 11/2014 | Kawai et al. | |
| 9,091,065 | B2 | 7/2015 | Tran et al. | |
| 9,163,424 | B2 | 10/2015 | Montgomery et al. | |
| 9,200,442 | B2 | 12/2015 | Richards | |
| 9,441,360 | B2 | 9/2016 | Matteson | |
| 9,464,427 | B2 | 10/2016 | Karns | |
| 9,506,239 | B2 | 11/2016 | Houghton | |
| 9,514,907 | B2 | 12/2016 | Mcmanus et al. | |
| 10,316,507 | B2 | 6/2019 | Richards | |
| 10,584,477 | B2 | 3/2020 | Richards | |
| 10,669,718 | B2 | 6/2020 | Pryor et al. | |
| 10,689,876 | B2 | 6/2020 | Richards | |
| 10,760,261 | B2 | 9/2020 | Richards | |
| 11,162,260 | B2 | 11/2021 | Pryor | |
| 11,479,988 | B2 | 10/2022 | Curtis | |
| 11,808,026 | B2 | 11/2023 | Zhao et al. | |
| 12,359,420 | B2 * | 7/2025 | Richards | E04B 1/2403 |
| 2002/0184836 | A1 | 12/2002 | Takeuchi et al. | |
| 2004/0050013 | A1 | 3/2004 | Okada et al. | |
| 2004/0144006 | A1 | 7/2004 | Chu | |
| 2004/0200178 | A1 | 10/2004 | Simmons | |
| 2004/0237456 | A1 | 12/2004 | Simmons | |
| 2005/0055970 | A1 | 3/2005 | Simmons | |
| 2005/0204684 | A1 | 9/2005 | Houghton | |
| 2006/0144006 | A1 | 7/2006 | Suzuki et al. | |
| 2006/0265992 | A1 | 11/2006 | Hiragaki | |
| 2009/0223166 | A1 | 9/2009 | Ohata et al. | |
| 2010/0205876 | A1 | 8/2010 | Christopoulus et al. | |
| 2010/0205891 | A1 | 8/2010 | Bong et al. | |
| 2011/0030305 | A1 | 2/2011 | Karns | |
| 2012/0017523 | A1 | 1/2012 | Ozaki et al. | |
| 2013/0074427 | A1 | 3/2013 | Kawai et al. | |
| 2014/0062648 | A1 | 3/2014 | McManus et al. | |
| 2014/0182234 | A1 | 7/2014 | Yang | |
| 2014/0325932 | A1 | 11/2014 | Karns et al. | |
| 2015/0096244 | A1 | 4/2015 | Richards | |
| 2015/0101268 | A1 | 4/2015 | Montgomery et al. | |
| 2015/0275501 | A1 | 10/2015 | Houghton | |
| 2016/0208478 | A1 | 7/2016 | Matteson | |
| 2016/0215492 | A1 | 7/2016 | Karns | |
| 2016/0356033 | A1 | 12/2016 | Houghton et al. | |
| 2017/0268252 | A1 | 9/2017 | Gray et al. | |
| 2018/0266099 | A1 | 9/2018 | Lippert | |
| 2018/0274223 | A1 | 9/2018 | Richards | |
| 2018/0347222 | A1 | 12/2018 | Richards | |
| 2019/0040645 | A1 | 2/2019 | Zhao et al. | |
| 2019/0292783 | A1 | 9/2019 | Pryor et al. | |
| 2020/0109556 | A1 | 4/2020 | Pryor | |
| 2021/0079681 | A1 | 3/2021 | Pryor et al. | |
| 2022/0154445 | A1 | 5/2022 | Zhao et al. | |
| 2022/0333369 | A1 * | 10/2022 | Richards | E04B 1/2403 |
| 2022/0333397 | A1 | 10/2022 | Richards | |
| 2023/0058224 | A1 | 2/2023 | Evans et al. | |
| 2023/0110886 | A1 | 4/2023 | Abela | |
| 2023/0117355 | A1 | 4/2023 | Robinson | |
| 2023/0175248 | A1 | 6/2023 | Richards | |
| 2024/0076892 | A1 * | 3/2024 | Gray | E04B 1/2403 |
| 2024/0392567 | A1 | 11/2024 | Felix | |

FOREIGN PATENT DOCUMENTS

| | | | |
|---|---|---|---|
| CL | 201503173 | | 9/2019 |
| CN | 109723145 | A | 5/2019 |
| EP | 3387196 | B1 | 11/2020 |
| JP | 2000144901 | A | 5/2000 |
| JP | 2002364068 | A | 12/2002 |
| JP | 2006233445 | A | 9/2006 |
| JP | 6876510 | B2 | 4/2021 |
| KR | 20040106829 | A | 12/2004 |
| KR | 100516332 | B1 | 9/2005 |
| KR | 101344813 | B1 | 12/2013 |
| KR | 20140039385 | A | 4/2014 |
| KR | 101406485 | B1 | 7/2014 |
| KR | 20140105643 | A | 9/2014 |
| WO | 2014085680 | A1 | 6/2014 |
| WO | 2016036564 | A1 | 3/2016 |
| WO | 2017100453 | A1 | 6/2017 |
| WO | 2019040297 | A1 | 2/2019 |
| WO | 2021030111 | A1 | 2/2021 |

OTHER PUBLICATIONS

Non-Final Office Action for U.S. Appl. No. 17/715,418 mailed Sep. 22, 2023.
Corrected Notice of Allowance for U.S. Appl. No. 15/500,991 mailed May 8, 2019.
Corrected Notice of Allowance for U.S. Appl. No. 16/394,665 mailed Feb. 11, 2020.
International Search Report and Written Opinion from International Application No. PCT/US2015/047006 mailed Nov. 23, 2015.
International Search Report and Written Opinion from International Application No. PCT/US2016/065623 mailed Mar. 10, 2017.
International Search Report and Written Opinion from International Application No. PCT/US2018/046222 mailed Nov. 14, 2018.
International Search Report and Written Opinion from International Application No. PCT/US2020/044982 mailed Oct. 26, 2020.
Issue Notification for U.S. Appl. No. 15/500,991 mailed May 22, 2019.
Issue Notification for U.S. Appl. No. 15/516,834 mailed Aug. 12, 2020.
Issue Notification for U.S. Appl. No. 16/394,665 mailed Feb. 19, 2020.
Non-Final Office Action for U.S. Appl. No. 15/500,991 mailed Jan. 18, 2018.
Non-Final Office Action for U.S. Appl. No. 15/516,834 mailed Aug. 30, 2018.
Non-Final Office Action for U.S. Appl. No. 16/101,075 mailed Jun. 27, 2019.
Notice of Allowance for U.S. Appl. No. 15/500,991 mailed Jun. 18, 2018.
Notice of Allowance for U.S. Appl. No. 15/500,991 mailed Oct. 2, 2018.
Notice of Allowance for U.S. Appl. No. 15/516,834 mailed Apr. 1, 2020.
Notice of Allowance for U.S. Appl. No. 15/516,834 mailed Dec. 23, 2019.
Notice of Allowance for U.S. Appl. No. 15/516,834 mailed Jun. 26, 2019.
Notice of Allowance for U.S. Appl. No. 15/516,834 mailed Mar. 8, 2019.
Notice of Allowance for U.S. Appl. No. 16/101,075 mailed Feb. 2020.
Notice of Allowance for U.S. Appl. No. 16/394,665 mailed Oct. 30, 2019.
Supplemental Notice of Allowability for U.S. Appl. No. 15/516,834 mailed Apr. 29, 2020.
Supplemental Notice of Allowability for U.S. Appl. No. 16/101,075 mailed May 28, 2020.
U.S. Appl. No. 15/500,991, filed Feb. 1, 2017.
U.S. Appl. No. 15/516,834, filed Apr. 4, 2017.
U.S. Appl. No. 62/044,738, filed Sep. 2, 2014.
U.S. Appl. No. 62/265,362, filed Dec. 9, 2015.
U.S. Appl. No. 62/549,853, filed Aug. 24, 2017.

(56) References Cited

OTHER PUBLICATIONS

U.S. Appl. No. 62/884,901, filed Aug. 9, 2019.
U.S. Appl. No. 63/174,663, filed Apr. 14, 2021.
Advisory Action for U.S. Appl. No. 17/715,418 mailed Jun. 13, 2024.
Final Office Action for U.S. Appl. No. 17/715,418 mailed Apr. 1, 2024.
Non-Final Office Action for U.S. Appl. No. 17/715,418 mailed Aug. 15, 2024.
Notice of Allowance for U.S. Appl. No. 17/71,429 mailed Jul. 9, 2024.
Notice of Allowance for U.S. Appl. No. 17/715,429 mailed Oct. 15, 2024.
U.S. Appl. No. 63/174,706, filed Apr. 14, 2021.
Notice of Allowance for U.S. Appl. No. 17/715,418 mailed Jan. 28, 2025.
Notice of Allowance for U.S. Appl. No. 17/715,429 mailed Feb. 3, 2025.
Issue Notification for U.S. Appl. No. 17/715,429 mailed Jul. 2, 2025.

* cited by examiner

COLUMN-TO-BEAM CONNECTION SYSTEMS INCLUDING A SHEAR COMPONENT

CROSS-REFERENCE TO RELATED APPLICATIONS

This is a U.S. National Stage application of PCT International Application No. PCT/US2020/044982 filed on Aug. 5, 2020, which claims priority to U.S. Provisional Application No. 62/884,901 filed on Aug. 9, 2019, the disclosure of each of which is incorporated, in its entirety, by this reference.

BACKGROUND

To resist wind and seismic loads, steel buildings may require braced frames, shear walls, or moment-resisting frames. Braced frames and shear walls may interfere with architectural features (open hallways, unobstructed windows, flexible floorplans) while moment-resisting frames may be more accommodating. Moment-resisting frames can rely on stiff and strong connections between the beams and columns to provide overall building stiffness and strength. However, moment-resisting frames may be more expensive than braced frames or shear walls because they are inherently less efficient and require more steel and expensive connections. It is desirable to develop steel moment-resisting frames that are economical to produce.

In addition, most moment-resisting frames are designed such that during earthquake loading the beams will yield and absorb damaging earthquake energy. This method of absorbing energy (beam yielding) can prevent building collapse and protect occupants, but makes buildings difficult or impractical to repair.

SUMMARY

In an embodiment, a column-to-beam connection system is disclosed. The column-to-beam connection system including a shear component configured to connect a flange of a beam to a flange of a column. The shear component includes a base plate configured to be connected to the flange of the column and at least one vertical web extending from the base plate. The at least one vertical web defines one or more openings therein.

In an embodiment, a moment-resisting frame is disclosed. The moment-resisting frame includes a column having a flange. The column flange exhibits a column width measured from a first edge of the column flange to a second edge of the column flange, wherein the second edge is opposite the first edge. The moment-resisting frame also includes a beam including a first beam flange and a second beam flange opposite the first beam flange. The moment-resisting frame also includes a column-to-beam connection system connecting the beam to the column. The column-to-beam connection system includes a shear component configured to connect the column flange to the first beam flange. The shear component includes a base plate configured to be connected to the column flange and at least one vertical web extending from the base plate. The at least one vertical web defines one or more openings therein.

In an embodiment, a method to repair a moment-resisting frame is disclosed. The method includes removing at least a portion of a shear component from the moment-resisting frame. The shear component connecting a column flange to a beam flange. The shear component including a base plate connected to the column flange and at least one vertical web extending from the base plate. The at least one vertical web defines one or more openings therein. The at least a portion of the shear component includes at least one yielded region that is adjacent to the one or more openings. The method also includes attaching a replacement component to the rest of the moment-resisting frame. The replacement component is substantially the same as the at least a portion of the shear component before the shear component yielded.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Column-to-beam connection systems are disclosed herein, along with moment-resisting frames including the same and methods of repairing the same. An example column-to-beam connection system includes a shear component (e.g., a structural shear fuse). The shear component includes a base plate that is connected to a column flange. The shear component also includes at least one vertical web extending from the base plate. The vertical web is connected to with a beam flange. The vertical web also defines one or more openings therein. As used herein, "connected to" may refer to actually connecting a component to another component or that a component is configured to be connected to another component. Further, "connected to" may refer to directly connecting a component to another component, indirectly connecting a component to another component, or both directly and indirectly connecting a component to another component.

The column-to-beam connection systems disclosed herein may form part of a moment-resisting frame. For example, the moment-resisting frame may include a column having at least one column flange and a beam having at least one beam flange. The column-to-beam connection system may couple the column to the beam. For example, the base plate may be connected to the column flange while the vertical web may be connected to the beam flange. The column-to-beam connection system may also couple the column to the beam using other attachment techniques, without limitation. For example, the column-to-beam connection system may include a shear tab, a top plate, one or more welds, an end plate, etc.

During loading, the moment-resisting frame may bend (e.g., flex, move, or otherwise strain). Bending the moment-resisting frame may cause the shear component of the column-to-beam connection system to be subjected to large shear forces. In particular, the vertical web of the shear component may be subjected to the large shear forces. The one or more openings formed in the vertical shear web may weaken parts of the vertical shear web such that the vertical shear web selectively and/or preferentially yields (e.g., buckles, fails, or otherwise deforms), in shear, during the loading. Yielding the vertical shear web absorbs at least some of the load which, in turn, may be sufficient to prevent other portions of the moment-resisting frame from yielding. Further, yielding the vertical web of the shear component may facilitate repair of the moment-resisting frame. For example, at least a portion of the shear component may be removed from the moment-resisting frame and replaced while other portions of the column-to-beam connection system maintain the structural integrity of the moment-resisting frame.

Figure 1B:
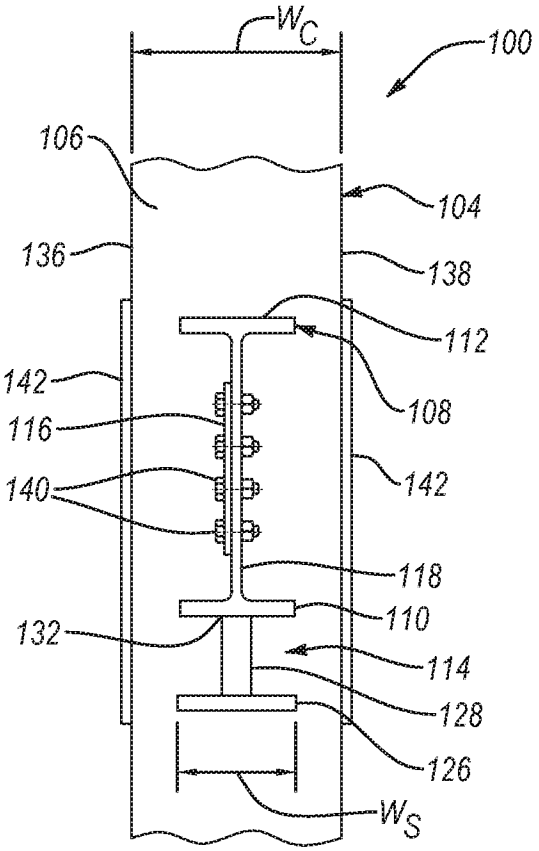
FIGS. 1A and 1B are side and front views, respectively, of a portion of a moment-resisting frame that includes a column-to-beam connection system, according to an embodiment.
Figure 1A:
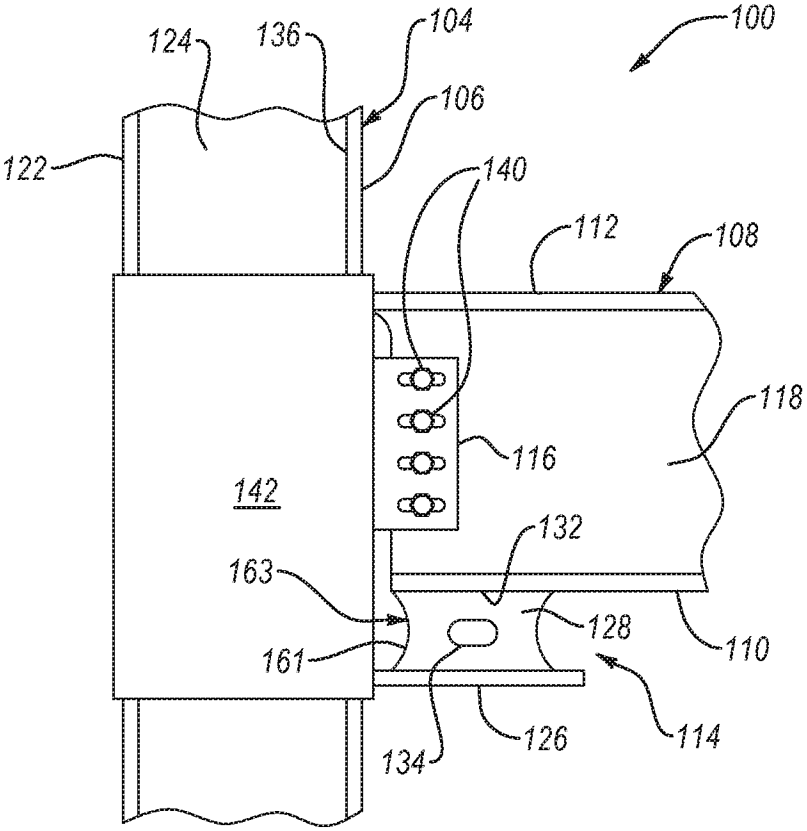

FIGS. 1A and 1B are side and front views, respectively, of a portion of a moment-resisting frame 100 that includes a column-to-beam connection system, according to an embodiment. The moment-resisting frame 100 includes a column 104 having a first column flange 106 and a beam 108 having a first beam flange 110 and a second beam flange 112 opposite the first beam flange 110. The beam 108 is connected to the first column flange 106 using the column-to-beam connection system. The column-to-beam connection system includes a shear component 114 connected to the column flange 106 and the first beam flange 110. The column-to-beam connection system may include other components such as, as illustrated, a shear tab 116 that connects a web 118 of the beam 108 to the first column flange 106 and a weld (not shown, obscured) that connects the second beam flange 112 to the first column flange 106. However, it is noted that the column-to-beam connection system may include other components as disclosed herein or as known in the art.

In an embodiment, as illustrated and discussed herein, the column-to-beam connection system is connected to the column 104 and the beam 108. In an embodiment, the column-to-beam connection system is not connected to the column 104 and/or the beam 108, such as when the column-to-beam connection system is provided but before the column-to-beam connection system is connected to the column 104 and/or the beam 108. In such an embodiment, the components of the column-to-beam connection system are configured to be connected to the column 104 and/or the beam 108 instead of actually connected to the column 104 and/or the beam 108, as disclosed herein.

In an embodiment, as shown, at least one of the column 104 or the beam 108 is an I-beam. In an example, the column 104 may include the first column flange 106, a second column flange 122 opposite the first column flange 106, and a column web 124 extending between the first column flange 106 and the second column flange 122. The first column flange 106 may be connected to the beam 108. The second column flange 122 may not be connected to another beam (as shown) or may be connected to another beam (not shown). In an example, the beam 108 may include the first beam flange 110, the second beam flange 112, and the beam web 118 extending between the first beam flange 110 and the second beam flange 112. In an embodiment, at least one of the column 104 or the beam 108 is not an I-beam. In such an embodiment, at least one of the column 104 or the beam 108 may include a hollow structural section, a T-beam, a double I-beam, or another other suitable structural beam.

The column 104 is connected to the beam 108 using the column-to-beam connection system. The column-to-beam connection system includes a shear component 114. The shear component 114 includes a base plate 126 and at least one vertical web 128. The base plate 126 generally extends in a horizontal direction that is, for example, generally parallel to the first and/or second beam flange 110, 112. The base plate 126 is configured to be connected to the first column flange 106. The vertical web 128 generally extends from the base plate 126 in a vertical direction that is, for example, generally perpendicular to the base plate 126 (e.g., is generally parallel to the column web 124 and/or the beam web 118). The vertical web 128 may be integrally formed with the base plate 126 (e.g., the shear component 114 is formed from a single piece), welded to the base plate 126, or connected to the base plate 126 using any suitable connection. The vertical web 128 is also connected to the first beam flange 110. In an embodiment, the shear component 114 may be a T-beam.

The base plate 126 and the vertical web 128 may be connected to the first column flange 106 and the first beam flange 110, respectively, using any suitable connection. In an embodiment, at least one of the base plate 126 is connected to the first column flange 106 via a weld or the vertical web 128 is connected to the first beam flange 110 via a weld 132. The welds may decrease the cost of connecting the column 104 to the beam 108 in certain locations, such as Central and South America where welding is cheaper than bolts. Further, the shear component 114 may be welded to one of the column 104 or the beam 108 offsite (e.g., in a welding shop) and then transported to the worksite to form the moment-resisting frame 100. Welding the shear component 114 to the first column flange 106 or the first beam flange 110 offsite may be performed cheaper, quicker, and more efficiently than if the welding was performed at the worksite. In an embodiment, at least one of the base plate 126 is connected to the first column flange 106 or the vertical web 128 is connected to the first beam flange 110 using bolts or another suitable connection. In such an embodiment, the bolts may decrease the cost of connecting the column 104 to the beam 108 in certain locations, such as in the United States of America. Further, the bolts may allow the moment-resisting frame 100 to be quickly and easily assembled even when the shear component 114 is not connected to the column 104 or the beam 108 offsite compared to welding.

The vertical web 128 defines one or more openings 134 therein. The openings 134 weaken the vertical web 128 such that the vertical web 128 selectively yields in shear when the moment-resisting frame 100 is subjected to large loads. Selectively yielding the vertical web 128 may absorb the load thereby allowing the other components of the moment-resisting frame 100 to remain intact and facilitate repair of the moment-resisting frame 100.

In an embodiment, the openings 134 exhibit a curved shape (e.g., circle, oval, a rectangle with rounded corners) thereby eliminating stress concentrators and increasing the overall strength of the vertical web 128. In an embodiment, the openings 134 may exhibit a shape having corners, such as a rectangle. The corners may decrease the overall strength of the vertical web 128 which may be necessary to ensure that the vertical web 128 yields before another component of the moment-resisting frame 100.

The vertical web 128 may define one opening 134 or a plurality of openings 134 (e.g., 2 to 4 or 3 to 5 openings 134). The number of openings 134 defined by the vertical web 128 may be selected based on the dimensions of the vertical web 128, the dimensions (e.g., diameter) of the openings 134, the desired stress (e.g., desired stress range) that is selected to yield the vertical web 128, and the desired stress distribution in the vertical web 128.

In an embodiment, one or more lateral edges 163 of the vertical web 128 may exhibit concave curvatures. The concave curvature of the lateral edges 163 may form one or more cutouts 161. The one or more cutouts 161 are openings formed in the vertical web 128.

In an embodiment, the shear component 114 may be positioned adjacent to and connected to the first beam flange 110, which typically is on the underside of the beam 108, to facilitate repair of the moment-resisting frame 100. For example, the floor may be built on the second beam flange 112. If the shear component 114 was positioned adjacent to the second beam flange 112, removing the floor to access the shear component 114 may be difficult, especially when the floor is concrete. When the shear component 114 is positioned adjacent to the first beam flange 110, only the ceiling may need to be removed to access the shear component 114 which may be significantly easier, more efficient, and more cost effective than removing the floor. In an embodiment, regardless of the above, the shear component 114 may be positioned adjacent to and connected to the second beam flange 112, for example, when the floor is not on the second beam flange 112 or the floor is easily removable.

Referring to FIG. 1B, the first column flange 106 exhibits a column width $W_C$ from a first edge 136 to a second edge 138 of the first column flange 106. The column width $W_C$ may be equal to or greater than a width of one or more components of the column-to-beam connection system. For example, the shear component 114 may exhibit a shear component width $W_S$ that is equal to or less than the column width $W_C$. The shear component width $W_S$ is equal to or less than the column width $W_C$ because the vertical web 128 defining the openings 134 extends in a vertical direction instead of a horizontal direction. For example, some conventional column-to-beam connection systems exhibit a width that is significantly greater than the column width $W_C$ Such conventional column-to-beam connection systems may interfere with some architectural features and/or may limited locations in which the conventional column-to-beam connection systems can be use (e.g., may not form or be positioned proximate to an exterior of a building) due to the bulged caused by such conventional column-to-beam connection systems.

As previously discussed, the column-to-beam connection system may include one or more additional components. In an embodiment, the column-to-beam connection system may include a shear tab 116. The shear tab 116 may be connected to the column flange 106 via welding or another suitable attachment technique. For example, the shear tab 116 may be connected to the first column flange 106 offsite. The shear tab 116 may also be connected to the beam web 118 using bolts 140 or another suitable attachment technique. In an embodiment, the column-to-beam connection system may include a weld that connects the second beam flange 112 to the first column flange 106. In an embodiment, the column-to-beam connection system may include one or more additional components, as further disclosed herein or as known in the art, instead of or in conjunction with the shear tab 116 and/or a weld.

In an embodiment, the moment-resisting frame 100 may include one or more components in addition to the column-to-beam connection system, the column 104, and the beam 108. In an example, the moment-resisting frame 100 may include at least one cover plate 142 attached to the first column flange 106 and the second column flange 122. The cover plate 142 may provide additional strength and rigidity to the column 104 thereby preventing deformation of the column 104 caused by the column-to-beam connection system. In an example, the moment-resisting frame 100 may include continuity plates (e.g., continuity plates 443 shown in FIG. 4A) or column web stiffeners (e.g., column web stiffeners 568 shown in FIG. 5) instead of or in addition to the cover plates 142. Similar to the cover plates 142, the column web stiffeners may increase the strength and rigidity of the column 104.

Figure 1C:
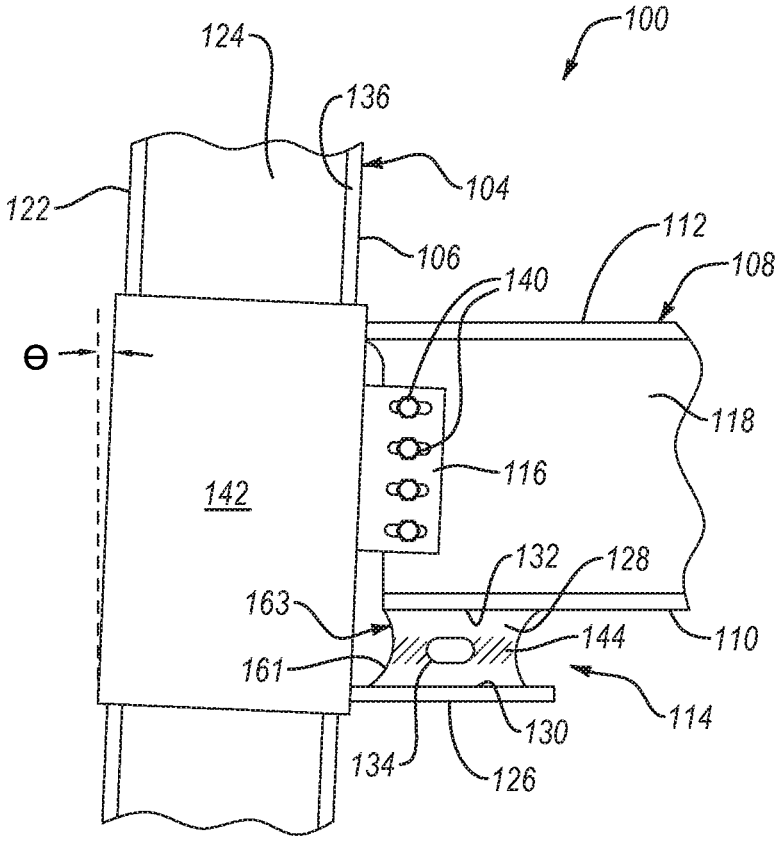
FIG. 1C is a side view of the moment-resisting frame shown in FIGS. 1A-1B when a load is applied to the moment-resisting frame, according to an embodiment.

FIG. 1C is a side view of the moment-resisting frame 100 shown in FIGS. 1A-1B when a load (e.g., a wind or seismic load) is applied to the moment-resisting frame 100, according to an embodiment. For example, the moment-resisting frame 100 may sway or otherwise move when a load is applied thereof. Swaying the moment-resisting frame 100 may cause the column 104 to tilt by an angle θ. The swaying of the moment-resisting frame 100 may cause a shear stress to be applied to the column-to-beam connection system. Since the vertical web 128 is weakened by the openings 134, the shear stress causes the vertical web 128 to yield. The shaded portions of the vertical web 128 illustrate the yielded regions 144 of the vertical web 128. Causing the vertical web 128 to yield causes the vertical web 128 to absorb energy from the load applied to the moment-resisting frame 100 thereby inhibiting the other components of the moment-resisting frame 100 from also yielding. It is noted that the cutouts 161 further weaken the vertical web 128 and further ensure that the yielded regions 114 of the vertical web 128 extends between the opening 134 and the cutouts 161. However, the cutouts 161 may be omitted from the vertical web 128 and the vertical web 128 may still yield as shown in FIG. 1C.

Figure 2B:
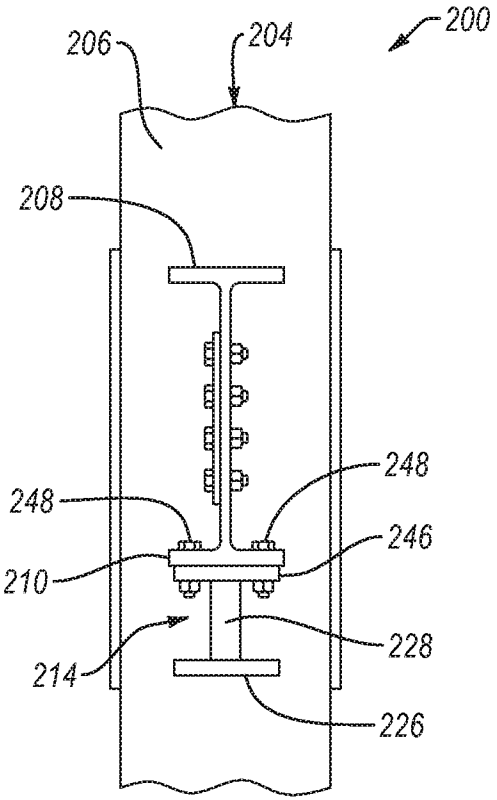
FIGS. 2A and 2B are side and front views, respectively, of a portion of a moment-resisting frame including a column-to-beam connection system, according to an embodiment.
Figure 2A:
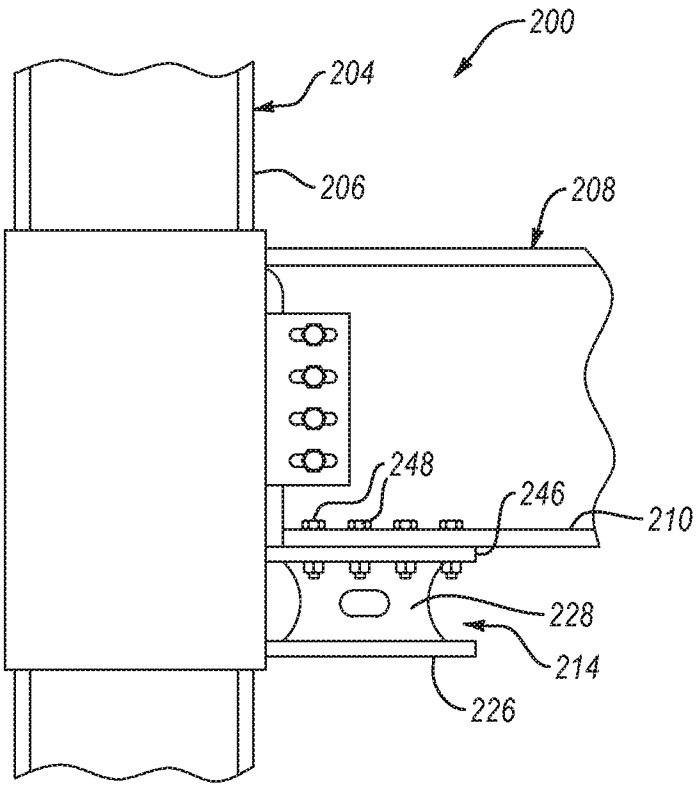

The shear component 114 illustrated in FIGS. 1A-1C exhibits a T-like cross-sectional shape. However, the shear components disclosed herein may exhibit other suitable shapes. For example, FIGS. 2A and 2B are a side and front view, respectively, of a portion of a moment-resisting frame 200 including a column-to-beam connection system, according to an embodiment. Except as otherwise disclosed herein, the moment-resisting frame 200 and the column-to-beam connection system is the same or substantially similar to any of the moment-resisting frames and column-to-beam connections systems, respectively, disclosed herein. For example, the moment-resisting frame 200 may include a column 204 and a beam 208. Further, the column-to-beam connection system may include a shear component 214 and, optionally, one or more additional components.

The shear component 214 exhibits a generally I-shaped cross-sectional shape. For example, the shear component 214 may include a base plate 226, an opposing plate 246 opposite the base plate 226, and at least one vertical web 228 extending between the base plate 226 and the opposing plate 246. Similar to the shear component 114 of FIGS. 1A-1C, the base plate 226 may be connected to the first column flange 206 and the vertical web 228 may define one or more openings 234 therein. However, the opposing plate 246 is configured to be connected (e.g., directly) to the first beam flange 210 (e.g., the vertical web 228 is indirectly connected to the first beam flange 210). In an embodiment, the shear component 214 is formed from an I-beam.

The increased width of the opposing plate 246 relative to the thickness of the vertical web 228 may facilitate attachment of the opposing plate 246 to the first beam flange 210. In an example, the increased width of the opposing plate 246 may facilitate attachment of the shear component 214 to the first beam flange 210 using one or more bolts 248. In an example, the increased width of the opposing plate 246 may exhibit a greater circumference that may be welded to the first beam flange 210 than the vertical web 228.

In an embodiment, the shear components disclosed herein may exhibit a shape other than a general T-like cross-sectional shape or a generally I-like cross-sectional shape. For example, the shear components disclosed herein may exhibit a generally rectangular cross-sectional shape (e.g., the shear component is a hollow structural section) or another suitable structure.

Figure 3B:
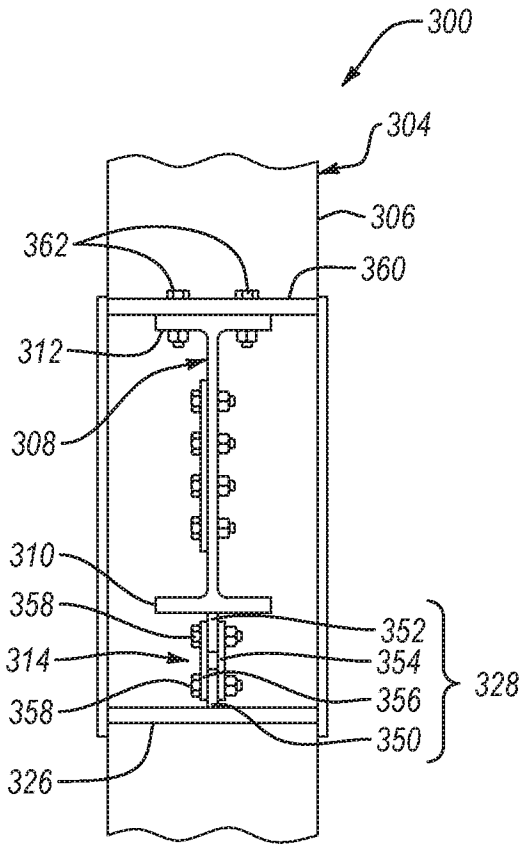
FIG. 3A to 3C are side, front, and top views, respectively, of a portion of a moment-resisting frame including a column-to-beam connection system, according to an embodiment.
Figure 3A:
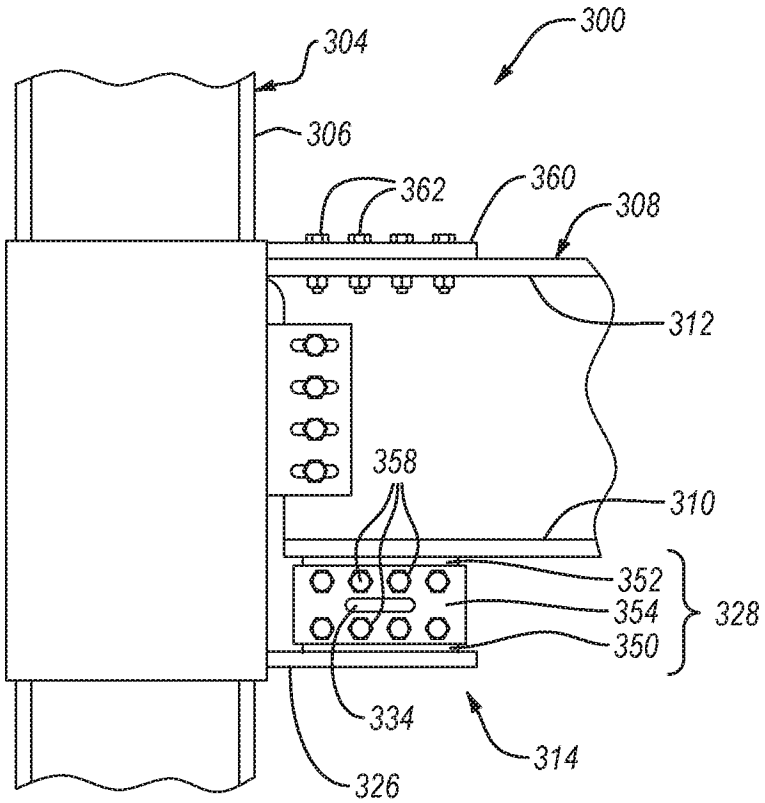
Figure 3D:
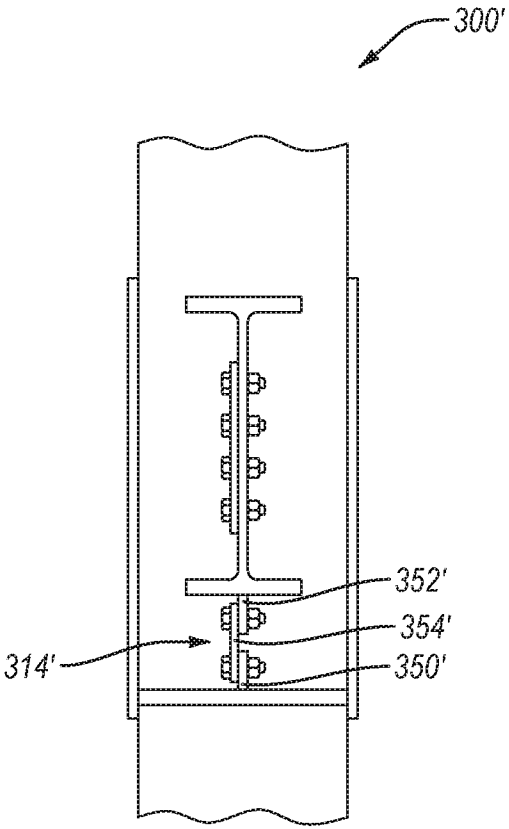
FIG. 3D is a front view of a moment-resisting frame including a column-to-beam connection system, according to an embodiment.
Figure 3C:
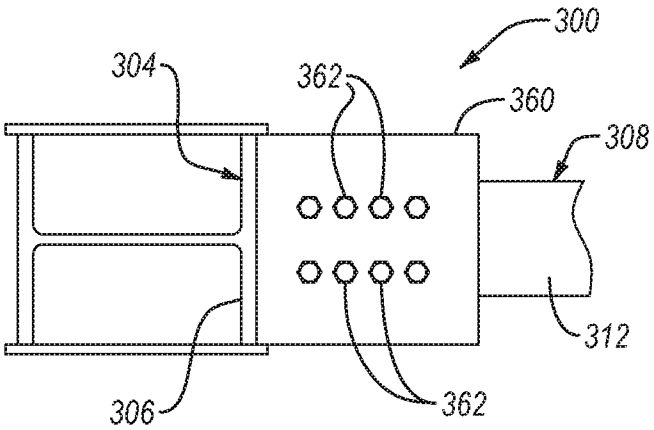

FIG. 3A to 3C are side, front, and top views, respectively, of a portion of a moment-resisting frame 300 including a column-to-beam connection system, according to an embodiment. Except as otherwise disclosed herein, the moment-resisting frame 300 is the same or substantially similar to any of the moment-resisting frames disclosed herein. For example, the moment-resisting frame 300 may include a column 304 and a beam 308. Further, the column-to-beam connection system may include a shear component 314 and, optionally, one or more additional components.

The shear component 314 includes a base plate 326 that is connected to a first column flange 306. The shear component 314 also includes a vertical web 328 formed from a plurality of interconnected pieces. For example, in the illustrated embodiment, the vertical web 328 includes a first vertical web 350 extending directly from the base plate 326. The first vertical web 350 may be integrally formed with the base plate 326 or may be connected to the base plate 326 using any suitable attachment technique (e.g., welding). The vertical web 328 also includes a second vertical web 352 extending from the first beam flange 310. The second vertical web 352 may be attached to the first beam flange 310 using any of the attachment techniques disclosed herein (e.g., welding or an opposing plate). The first vertical web 350 is distinct from the second vertical web 352 and, optionally, the first vertical web 350 may be spaced from the second vertical web 352 when the shear component 314 is assembled. The vertical web 328 also includes at least one connector web, such as a first connector web 354 and a second connector web 356 (shown in FIG. 3B). The first and second connector webs 354, 356 are configured to be attached to both the first and second vertical webs 350, 352 such that the first and second vertical webs 350, 352 are connected together via the first and second connector webs 354, 356. The first connector web 354 is positioned adjacent to a first side of the first and second vertical webs 350, 352 while the second connector web 356 is positioned adjacent to a second side of the first and second vertical webs 350, 352 that is opposite the first side. The first and second connector webs 354, 356 may be connected to the first and second vertical webs 350, 352 using any suitable connection technique, such as using one or more bolts 358 or welds.

It is noted that the vertical web 328 may only include a single connector web. For example, FIG. 3D is a front view of a portion of a moment-resisting frame 300' including a column-to-beam connection system, according to an embodiment. The moment-resisting frame 300' is the same as the moment-resisting frame 300 illustrated in FIGS. 3A-3C except that the shear component 314' only includes a single connector web 354' that connects the first vertical web 350' to the second vertical web 352'.

Referring back to FIGS. 3A-3C, the vertical web 328 defines one or more openings 334 therein. In an embodiment, at least one of the first connector web 354 or the second connector web 356 defines the openings 334 since the first and second connector webs 354, 356 may have a larger surface area than and/or are easier to replace than the first and second vertical webs 350, 352. In an embodiment, at least one of the first vertical web 350 or the second vertical web 352 may define the openings 334 therein.

The column-to-beam connection system may also include a top plate 360 that is connected to the first column flange 306 and the second beam flange 312 thereby connecting the column 304 to the beam 308. The top plate 360 may be connected to the first column flange 306 and the second beam flange 312 using any suitable attachment technique. For example, as illustrated, the top plate 360 may be connected to the first column flange 306, such as welded to the first column flange 306 offsite. The top plate 360 may then be connected to the second beam flange 312 using one or more bolts 362 which may allow quick attachment of the top plate 360 to the second beam flange 312 at the worksite. It is noted that any of the column-to-beam connection systems disclosed herein may include the top plate 360.

Figure 4B:
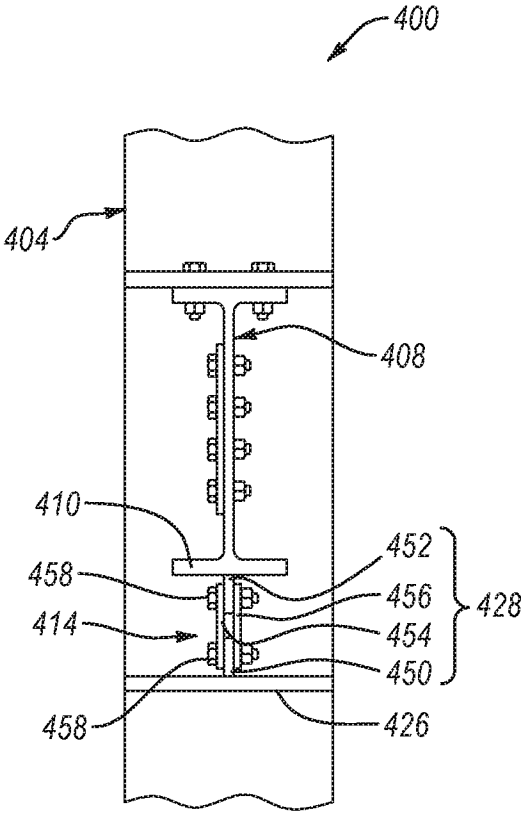
FIGS. 4A and 4B are side and front views of a portion of a moment-resisting frame including a column-to-beam connection system, according to an embodiment.
Figure 4A:
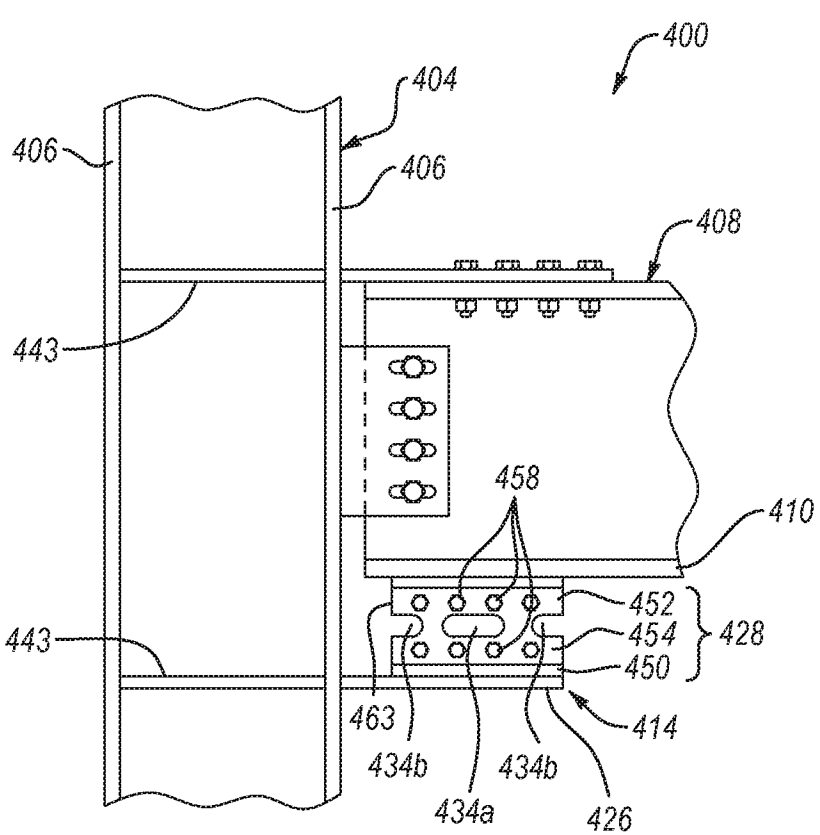

FIGS. 4A and 4B are side and front views of a portion of a moment-resisting frame 100 including a column-to-beam connection system, according to an embodiment. Except as otherwise disclosed herein, the moment-resisting frame 400 is the same or substantially similar to any of the moment-resisting frames disclosed herein. For example, the moment-resisting frame may include a column 404 and a beam 408. Further, the column-to-beam connection component may include a shear component 414 and, optionally, one or more additional components.

The shear component 414 includes a base plate 426 that is connected to a column flange 406. The shear component 414 also includes a vertical web 428 formed from a plurality of interconnected pieces. For example, in the illustrated embodiment, the vertical web 428 includes a first vertical web 450 extending directly from the base plate 426. The first vertical web 450 may be integrally formed with the base plate 426 or may be connected to the base plate 426 using any suitable attachment technique (e.g., welding). The vertical web 428 also includes a second vertical web 452 extending from a beam flange 410. The second vertical web 452 may be attached to the first beam flange 410 using any of the attachment techniques disclosed herein (e.g., welding or an opposing plate). The first vertical web 450 is distinct from the second vertical web 452 and, optionally, the first vertical web 450 may be spaced from the second vertical web 452 when the shear component 414 is assembled. The vertical web 428 also includes at least one connector web, such as a first connector web 454 and a second connector web 456 (shown in FIG. 4B). The first and second connector webs 454, 456 are configured to be attached to both the first and second vertical webs 450, 452 such that the first and second vertical webs 450, 452 are connected together via the first and second connector webs 454, 456. The first connector web 454 is positioned adjacent to a first side of the first and second vertical webs 450, 452 while the second connector web 456 is positioned adjacent to a second side of the first and second vertical webs 450, 452 that is opposite the first side. The first and second connector webs 454, 456 may be connected to the first and second vertical webs 450, 452 using any suitable connection technique, such as using one or more bolts 458 or welds.

The vertical web 428 defines a plurality of openings therein. In an embodiment, the first connector web 454 defines the plurality opening. The plurality of openings may include at least one inner opening 434*a* spaced from the lateral edges 463 of the first connector web 454 and at least one outer opening 434*b* extending inwardly from the lateral edges 463 (e.g., extending from the lateral edges 463 partially towards the inner opening 434*a*). The plurality of openings may increase the complexity of forming the first connector web 454 than if the first connector web 454 only included a single opening (similar to the first connector web 334 illustrated in FIG. 3A). However, the plurality of openings may cause the stress to be more equally distributed to the bolts 458 that connect the plurality of pieces of the vertical web 428 together than if the first connector web 454 only included a single opening. For example, as illustrated, the plurality of openings are positioned on the first connector web 454 such that one of the plurality of openings are between each opposing pair of bolts 458 (i.e., bolts 458 that are spaced apart from each other in a direction that is parallel to or substantially parallel to a longitudinal axis of the column 406). Positioning the plurality of openings between opposing pair of bolts 458 causes the opposing pair of bolts 458 to have stress more equally distributed therebetween than if at least one of the opposing pair of bolts 458 had an opening therebetween while at least one other opposing pair of bolts 458 did not have an opening therebetween.

The moment-resisting frames illustrated in FIGS. 1A-3D include at least one cover plate mounted to the columns. The cover plates increase the stiffness of the moment-resist frames. However, the cover plates make connecting other components to the column (e.g., another beam opposite the beam illustrated in FIGS. 1A-3D) more difficult. Further, the cover plates may make retrofitting the column to include the moment-resisting frame more difficult since any other beam connected to the column made need to be temporarily detached from the column to attach the cover plate. As such, as illustrated in FIG. 4A, in some embodiments, the cover plate may be omitted from the moment-resisting frame 400. Instead, the moment-resisting frame 400 may include one or more continuity plates 443 within the flanges 406 of the column 404. The continuity plates 443 may decrease the stiffness of the moment-resisting frame 400 than if the moment-resisting frame 400 included at least one cover plate. However, the continuity plates 443 may make attaching a second beam orthogonal to the beam 408 easier since the cover plate does not need to be removed to attach the second beam. Further, the continuity plates 443 may make retrofitting an existing frame to include any of the column-to-beam connection systems disclosed herein easier since any other beam attached to the column 406 opposite the beam 408 does not need to be temporarily detached when making the retrofit.

Figure 5:
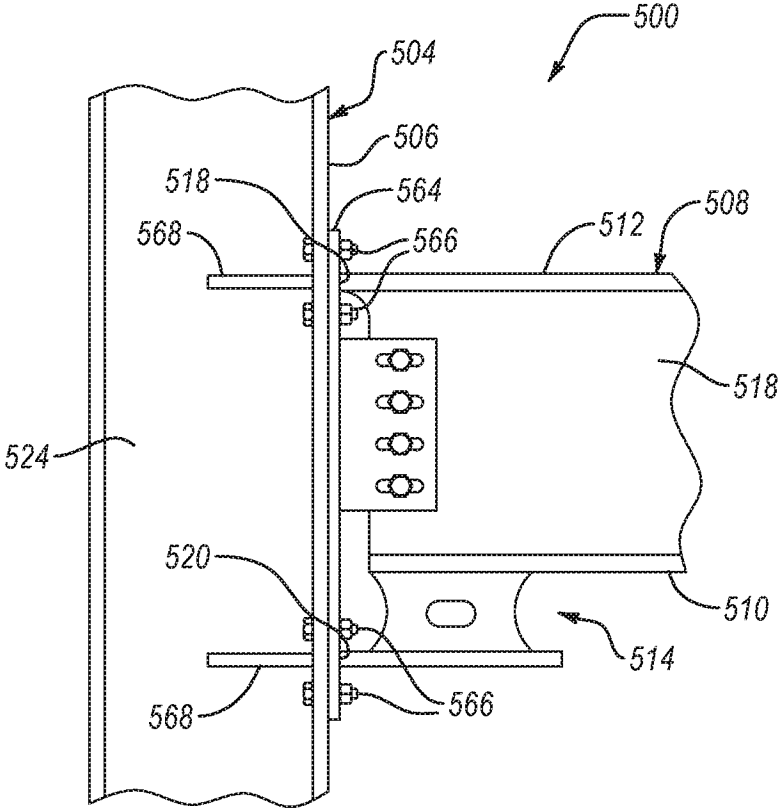
FIG. 5 is a side view of a portion of a partially restrained moment-resisting frame including a column-to-beam connection system, according to an embodiment.

The moment-resisting frames illustrate in FIGS. 1A-3D are fully restrained moment-resisting frames (i.e., most of the bolts or connections between the column and the beam are in shear). However, the principles and features disclosed herein may be used in partially restrained moment-resisting frames (i.e., most of the bolts or connections between the column and the beam are in tension). For example, FIG. 5 is a side view of a portion of a partially restrained moment-resisting frame 500 including a column-to-beam connection system, according to an embodiment. Except as otherwise disclosed herein, the moment-resisting frame 500 may be the same or substantially similar to any of the moment-resisting frames disclosed herein. For example, the moment-resisting frame 500 may include a column 504 and a beam 508 that are connected together using at least a shear component 514. The shear component 514 in the illustrated embodiment may be the same or substantially similar to the shear component 114 illustrated in FIGS. 1A-1C. However, the shear component 514 may be the same or substantially similar to any of the other shear components disclosed herein.

The column-to-beam connection system includes an end plate 564. The end plate 564 may be directly connected to the first column flange 506 of the column 504 using any suitable attachment technique, such as with a plurality of bolts 566 (as shown) or a weld. The end plate 564 may also be connected the beam 508. For example, in the illustrated embodiment, the end plate 564 is connected indirectly to the first beam flange 510 via the shear component 514 and directly to the second beam flange 512. The end plate 564 may be connected to the shear component 514 using any suitable attachment technique, such as with a weld 520. The end plate 564 may be connected to the second beam flange 512 using any suitable attachment technique, such as with a weld 518 or a top plate.

In an embodiment, the end plate 564 is connected to the beam 508 offsite and then provided to the work site. As previously discussed, connecting the end plate 564 to the beam 508 offsite may be easier, faster, cheaper, etc. The end plate 564, as shown in the illustrated embodiment, may then be connected to the column 504 using bolts 566 which may be quicker and cheaper, depending on location, than welding the end plate 564 to the column 504.

As previously discussed, the moment-resisting frame 500 may include other components. For example, as illustrated, the moment-resisting frame 500 may include one or more column web stiffeners 568 attached to the column web 524. The column web stiffeners 568 may increase the strength and/or rigidity of the column 504 at or near the connection between the column 504 and the beam 508.

Figure 6:
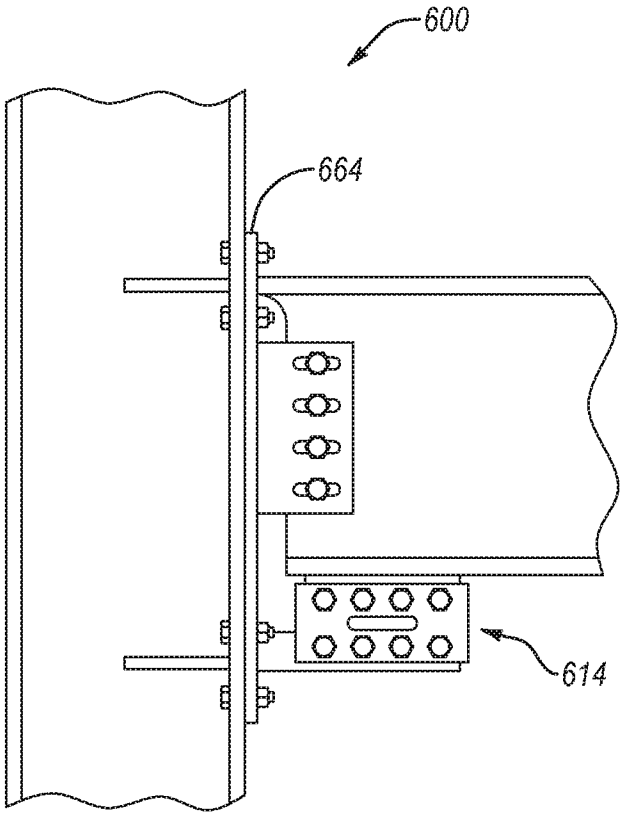
FIG. 6 is a side view of a portion of a moment-resisting frame including a column-to-beam connection system, according to an embodiment.

The partially restrained moment-resisting frames disclosed herein may be used with different shear components. For example, FIG. 6 is a side view of a portion of a moment-resisting frame 600 including a column-to-beam connection system, according to an embodiment. The moment-resisting frame 600 may be substantially the same as the moment-resisting frame 500 shown in FIG. 5. For example, the column-to-beam connection system includes a shear component 614 connected to the end plate 664. However, the shear component 614 may be the same or substantially similar to the shear component 314, 314', 414 shown in FIGS. 3A-4B.

Figure 7:
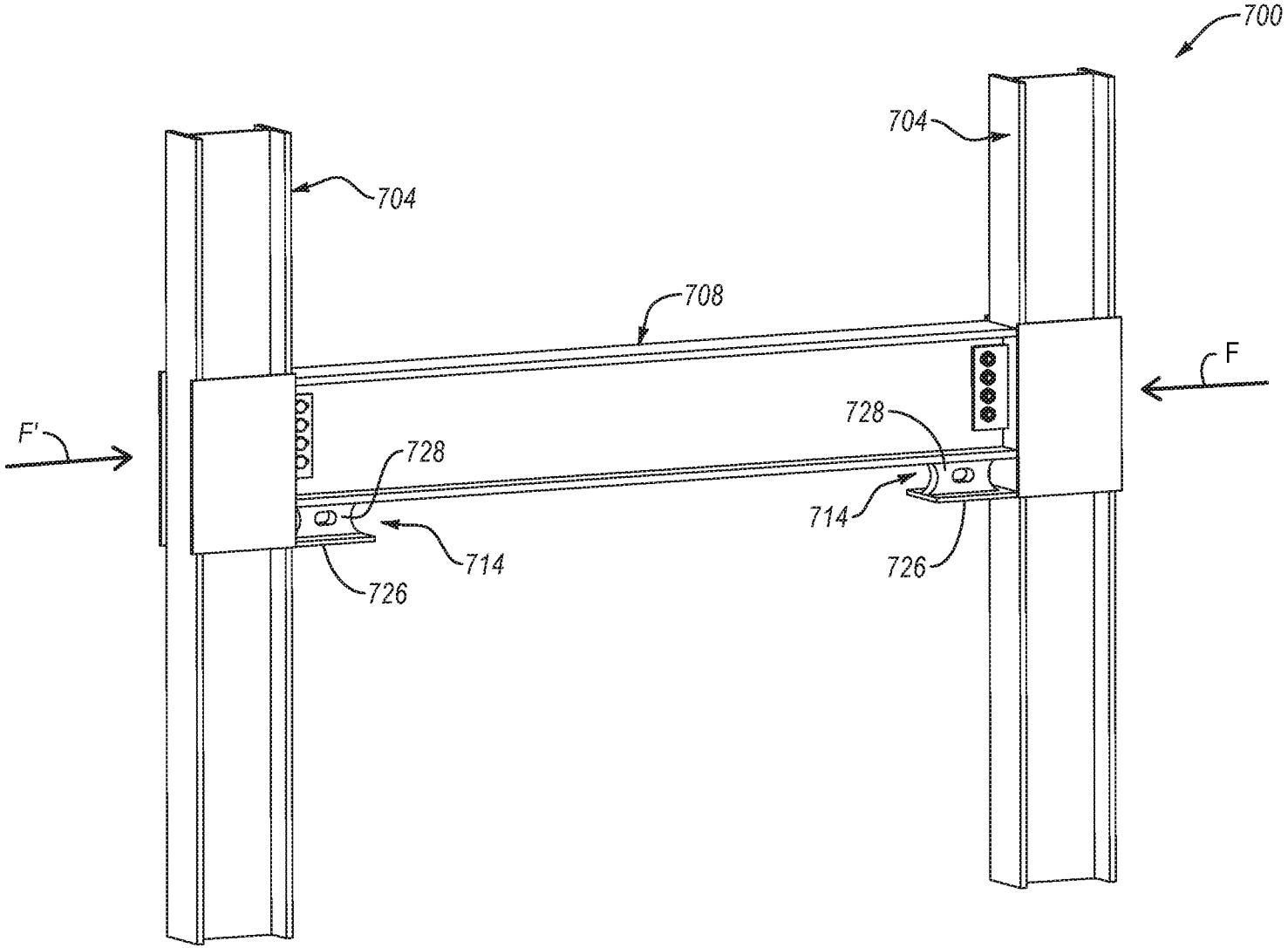
FIG. 7 is an isometric view of a moment-resisting frame, according to an embodiment.

FIG. 7 is an isometric view of a moment-resisting frame 700, according to an embodiment. The moment-resisting frame 700 may include one or more horizontally oriented beams 708 connected to and extending between opposing vertical columns 704. Each beam 708 may be connected to one of the columns 704 using a column-to-beam connection system that is the same as or substantially similar to any of the column-to-beam connection systems disclosed herein. For example, the column-to-beam connection system may include a shear component 714. The shear component 714 may include a base plate 726 and at least one vertical web 728 extending from the base plate 726. The column-to-beam connection system may also include other components, such as welds, top plates, end plates, or any other component known in the art.

In an embodiment, application of a lateral force F or F' to the moment-resisting frame 700 may produce bending and/or twisting (e.g., elastic or plastic deformation) to the columns 704 and/or the beams 708. The lateral force F or F' may be applied to the moment-resisting frame 700 due to one or more of seismic activity, a wind loading event, or some other cause. The column-to-beam connection system may hold the columns 704 and the beams 708 together while the lateral force F or F' are applied to the moment-resisting frame. However, the shear component 714 may yield thereby absorbing at least some of the lateral force.

Figure 8:
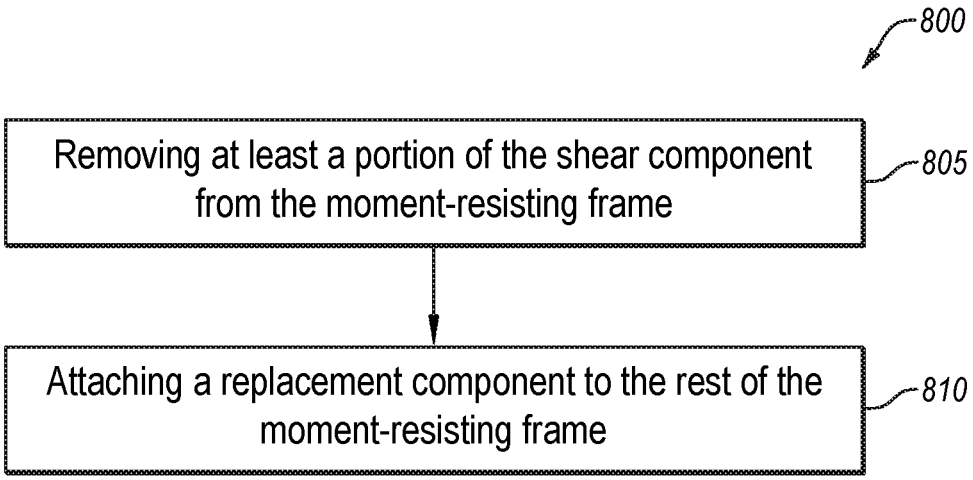
FIG. 8 is a flow chart of a method of repairing a shear component, according to an embodiment.

Yielding of the shear component may require the shear component to be repaired. FIG. 8 is a flow chart of a method 800 of repairing a shear component, according to an embodiment. The method includes, in block 805, removing at least a portion of the shear component ("removed component") from the moment-resisting frame. The removed component may include at least a yield region of the shear component. For example, the removed component may include all of the shear component, all of the vertical web, a portion of the vertical web (e.g., removing the connector web), and/or any other portion of the shear component.

The method used to remove the removed component may depend on how the removed component is attached to the rest of the moment-resisting frame. In an example, removing the removed component may include cutting or grinding the removed component from the rest of the moment-resisting frame when the removed component is welded to the rest of the moment-resisting frame. In an example, removing the removed component may include unbolting the removed component from the rest of the moment-resisting frame when the removed component is bolted to the rest of the moment-resisting frame. In an example, removing the removed component may include both cutting or grinding and unbolting the removed component from the rest of the moment-resisting frame when the removed component is both welded and bolted to the rest of the moment-resisting frame.

After block 805, the method may include, in block 810, attaching a replacement component to the rest of the moment-resisting frame. The replacement component may be the same or similar to the removed component. Attaching the replacement component to the rest of the moment-resisting frame may include welding, bolting, or using another other suitable attachment technique to attach the replacement component to the rest of the moment-resisting frame. In an example, attaching the replacement component to the rest of the moment-resisting frame may include attaching the replacement component to the rest of the moment-resisting frame using the same technique that was used to attach the removed component to the rest of the moment-resisting frame.

In an embodiment, the method 800 may include gaining access to the shear component. In an example, gaining access to the shear component may include removing at least a portion of a ceiling to access the shear component, for instance, when the shear component is attached to the underside (e.g., the first beam flange) of the beam. In an example, gaining access to the shear component may include removing at least a portion of a floor to access the shear component, for instance, when the shear component is attached to the top (e.g., the second beam flange) of the beam.

In an embodiment, instead of the method 800, a method of repairing a shear component that includes a yielded region may include attaching a plate over the yielded region. For example, the plate that is attached to the yield portion may correspond to the yielded region and may exhibit a size that is greater than the yield portion. As such, the plate that is attached to the yield portion may support a majority of any loads that are applied to the shear component instead of the yield portion.

In an embodiment, an existing frame (e.g., an existing moment-resisting frame) may be retrofitted to include any of the column-to-beam connection systems disclosed herein. Retrofitting the frame may include supporting at least a portion of the existing frame such that the beam(s) and column(s) of the existing frame maintain their position when the connectors of the existing frame are removed. Retrofitting the frame may then include removing the connectors of the existing frame. Removing the connectors may include cutting welds, unbolting bolts, etc. After removing the connectors, retrofitting the existing frame may include removing components of the frame that will not be included in the moment-resisting frame. Retrofitting the existing frame may then include attaching any of the column-to-beam connection systems disclosed herein to the frame, such as attaching one or more of a vertical web, a top plate, one or more cover plates, one or more continuity plates, one or more shear tabs, end plate, etc. to the existing frame.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, +2% or 0% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

I claim:

1. A moment-resisting frame, comprising:

a column having a column flange, the column flange exhibiting a column width measured from a first edge of the column flange to a second edge of the column flange, wherein the second edge is opposite the first edge;

a beam including a first beam flange and a second beam flange opposite the first beam flange; and a shear component connected to the column flange and one of the first beam flange or the second beam flange, the shear component including:

a base plate connected to the column flange; and at least one vertical web extending from the base plate, the at least one vertical web defining one or more openings therein, the one or more openings exhibiting an elongated shape oriented such that a longitudinal axis thereof is substantially parallel to the flange of the beam, the vertical web configured to yield and form at least one yielded region between the one or more openings and at least one of an adjacent opening or a lateral edge of the vertical web, the lateral edge extending from the base plate towards the flange of the beam.

2. The moment-resisting frame of claim 1, wherein the at least one vertical web is configured to be directly connected to the first beam flange or the second beam flange.

3. The moment-resisting frame of claim 1, wherein the shear component further includes a top plate configured to be directly connected to the first beam flange or the second beam flange of the beam, and wherein the at least one vertical web is configured to extend between the base plate and the top plate.

4. The moment-resisting frame of claim 1, wherein the one or more openings includes at least one inner opening spaced from respective lateral edges of the at least one vertical web and at least one outer opening extending inwardly from at least one of the lateral edges of the at least one vertical web.

5. The moment-resisting frame of claim 1, further comprising a top plate configured to be connected to the flange of the column, the shear component is configured to be connected to the first beam flange of the beam and the top plate configured to be connected to the second beam flange of the beam.

6. The moment-resisting frame of claim 1, wherein at least one of the column or the beam is an I-beam.

7. The moment-resisting frame of claim 1, wherein the shear component exhibits a shear component width that is less than the column width, wherein the shear component width is measured parallel to the column width.

8. The moment-resisting frame of claim 1, wherein the base plate is welded directly to the column flange.

9. The moment-resisting frame of claim 1, wherein the at least one vertical web is welded directly to the first beam flange.

10. The moment-resisting frame of claim 1, wherein the at least one vertical web includes:

a first vertical web extending directly from the base plate;

a second vertical web that is distinct from the first vertical web; and at least one connector web configured to be coupled to the first vertical web and the second vertical web, the at least one connector web defining the one or more openings therein.

11. The moment-resisting frame of claim 1, further comprising a top plate connected to the second beam flange.

12. The moment-resisting frame of claim 1, wherein the shear component further includes an opposing plate directly coupled to the first beam flange, wherein the at least one vertical web extends between the base plate and the opposing plate.

13. The moment-resisting frame of claim 12, wherein the opposing plate is bolted to the first beam flange.

14. The moment-resisting frame of claim 1, further comprising an end plate that is directly attached to the column flange, wherein the beam and the base plate are coupled to the end plate.

15. The moment-resisting frame of claim 14, wherein the end plate is connected to the column flange using a plurality of bolts.

16. The moment-resisting frame of claim 1, wherein the elongated shape is one of substantially rectangular or substantially oval.

17. A method of repairing the moment-resisting frame of claim 1, the method comprising:

removing at least a portion of the shear component from the moment-resisting frame, the moment-resisting frame including the column having the column flange and the beam having the first beam flange, the shear component including the base plate and the at least one vertical web defining the one or more openings therein, wherein the at least a portion of the shear component includes the at least one yielded region is adjacent to the one or more openings;

wherein, at least before removing at least a portion of the shear component from the moment-resisting frame, the shear component connects the first beam flange to the column flange, the base plate is connected to the flange of the column, and the at least one vertical web extends from the base plate; and attaching a replacement component to the rest of the moment-resisting frame, wherein the replacement component is substantially the same as the at least a portion of the shear component before the shear component yielded.

18. The method of claim 17, wherein:

removing at least a portion of the shear component from the rest of the moment-resisting frame includes grinding or cutting the at least a portion of the shear component; and attaching a replacement component to the moment-resisting frame includes welding the replacement component to the rest of the moment-resisting frame.

19. The method of claim 17, wherein:

removing at least a portion of the shear component from the rest of the moment-resisting frame includes unbolting the at least a portion of the shear component from the rest of the moment-resisting frame; and attaching a replacement component to the moment-resisting frame includes bolting the replacement component to the rest of the moment-resisting frame.

* * * * *